US008508442B2

(12) United States Patent
Yoo

(10) Patent No.: US 8,508,442 B2
(45) Date of Patent: Aug. 13, 2013

(54) ORGANIC LIGHT EMITTING DISPLAY DEVICE AND DRIVING METHOD THEREOF

(75) Inventor: Young-Wook Yoo, Yongin (KR)

(73) Assignee: Samsung Display Co., Ltd., Yongin (KR)

( * ) Notice: Subject to any disclaimer, the term of this patent is extended or adjusted under 35 U.S.C. 154(b) by 288 days.

(21) Appl. No.: 12/984,504

(22) Filed: Jan. 4, 2011

(65) Prior Publication Data

US 2011/0187754 A1 Aug. 4, 2011

(30) Foreign Application Priority Data

Feb. 3, 2010 (KR) ..... 10-2010-0010001

(51) Int. Cl.
*G09G 3/30* (2006.01)

(52) U.S. Cl.
USPC ..... 345/77; 345/76; 345/690

(58) Field of Classification Search
USPC .... 345/55, 76, 77, 211–214, 690; 315/169.1, 315/169.3
See application file for complete search history.

(56) References Cited

U.S. PATENT DOCUMENTS

| | | | | |
|---|---|---|---|---|
| 5,289,282 | A * | 2/1994 | Tsuji et al. | 348/624 |
| 7,102,695 | B2 * | 9/2006 | Han et al. | 348/673 |
| 7,245,308 | B2 * | 7/2007 | Kiuchi et al. | 345/643 |
| 7,613,338 | B2 * | 11/2009 | Yano | 382/162 |
| 7,973,753 | B2 * | 7/2011 | Mori | 345/89 |
| 8,035,607 | B2 * | 10/2011 | Otome | 345/102 |
| 8,223,163 | B2 * | 7/2012 | Nobori | 345/581 |
| 2003/0122845 | A1 * | 7/2003 | Lee et al. | 345/589 |
| 2004/0036704 | A1 * | 2/2004 | Han et al. | 345/690 |
| 2005/0169524 | A1 * | 8/2005 | Moriya | 382/167 |
| 2006/0033445 | A1 * | 2/2006 | Kim et al. | 315/169.3 |
| 2006/0268180 | A1 * | 11/2006 | Chou | 348/673 |
| 2008/0252628 | A1 * | 10/2008 | Han et al. | 345/207 |
| 2010/0039451 | A1 * | 2/2010 | Jung | 345/690 |
| 2011/0018892 | A1 * | 1/2011 | Otawara et al. | 345/589 |

FOREIGN PATENT DOCUMENTS

| | | | |
|---|---|---|---|
| KR | 1996-0011974 | B1 | 9/1996 |
| KR | 10-2007-0024143 | A | 3/2007 |
| KR | 10-2009-0050147 | A | 5/2009 |
| KR | 10-2009-0060051 | A | 6/2009 |
| KR | 10-1107678 | B1 | 1/2012 |

OTHER PUBLICATIONS

Korean Office Action dated Mar. 5, 2012 for Korean Patent Application No. KR 10-2010-0010001.

* cited by examiner

*Primary Examiner* — Dmitriy Bolotin
(74) *Attorney, Agent, or Firm* — Knobbe, Martens, Olson & Bear LLP

(57) ABSTRACT

An organic light emitting display and a method of driving the display are disclosed. The display uses an automatic current limit driving method. The method includes comparing current and previous frames of data to select a peak brightness ratio for displaying the current frame. If the difference between the frames is greater than a threshold, the peak brightness ratio of the previous frame is used for the current frame.

20 Claims, 5 Drawing Sheets

ORGANIC LIGHT EMITTING DISPLAY DEVICE AND DRIVING METHOD THEREOF

CROSS-REFERENCE TO RELATED APPLICATIONS

This application claims priority to and the benefit of Korean Patent Application No. 10-2010-0010001, filed on Feb. 3, 2010, in the Korean Intellectual Property Office, the entire content of which is incorporated herein by reference.

BACKGROUND

1. Field

The disclosed technology relates to an organic light emitting display device, and more particularly, to an organic light emitting display device with automatic current limit driving and a driving method thereof.

2. Description of the Related Technology

Various flat panel display devices with reduced weight and volume as compared to cathode ray tube devices have been developed and commercialized. Examples of flat panel displays used in current products include liquid crystal displays, field emission displays, plasma display panels, organic light emitting diode (OLED) displays, etc.

An organic light emitting device displays an image by using organic light emitting diodes that emit light by recombining holes with electrons.

Organic light emitting displays are used in PDAs, MP3 players, DSCs, cell phones, etc. The market for OLED displays is expanding remarkably due to advantages such as excellent color reproducibility and thinness.

However, because an OLED display emits light dependent on an amount of current, it tends to consume a large amount of current when emitting bright light. Such a display should preferably have lower power consumption so that it can be used in mobile device where power from a battery is at a premium.

In order to reduce power consumption, automatic current limit (ACL) driving technology can be used. ACL reduces consumption of current by controlling the amount of current consumed in a display panel and implements a dynamic contrast.

ACL driving has advantages of dynamic contrast and reduction of power consumption, while its disadvantage is the generation of flicker.

SUMMARY OF CERTAIN INVENTIVE ASPECTS

One inventive aspect is an organic light emitting display device, which has a pixel unit including a plurality of pixels connected with scan lines and data lines. The display device also includes a timing controller configured to supply frames of first data, and a converter configured to receive the frames of first data. The converter includes a color coordinate converter configured to determine luminance components of the first data, a peak brightness ratio (PBR) generator, configured to determine a PBR for the first data of each frame, and a data converter configured to generate second data for each frame based on the first data for each frame and on a PBR. The display device also includes a data driver configured to receive the second data from the converter and to provide the second data to the data lines.

Another inventive aspect is a method of driving an organic light emitting display device. The method includes converting color coordinates of first data of a plurality of frames, extracting luminance information of the converted first data of successive frames, and comparing and analyzing histogram data of the luminance information of the first data of the successive frames. The method also includes detecting whether the number of maximum and minimum gray-scales in the luminance information for a current frame is different from the number of maximum and minimum gray-scales in the luminance information of a previous frame, and based on a difference in the number of maximum and minimum gray-scales in the current and previous frames, determining whether flicker in the current frame is anticipated. The method also includes converting the first data of each frame to second data for each frame by applying a peak brightness ratio (PBR) value to the first data of each frame, where if flicker is anticipated the peak brightness ratio value is equal to a peak brightness ratio value applied to the previous video frame.

Another inventive aspect is an organic light emitting display device. The display device has a pixel unit including a plurality of pixels, and a converter configured to receive frames of first data. The converter includes a peak brightness ratio (PBR) generator configured to determine a PBR for the first data of each frame, and a data converter configured to generate second data for each frame based on the first data for each frame and on a selected one of the generated PBRs. The display device also includes a data driver configured to provide the second data to the data lines.

BRIEF DESCRIPTION OF THE DRAWINGS

The accompanying drawings, together with the specification illustrate exemplary embodiments, and, together with the description, serve to explain various inventive aspects and principles.

DETAILED DESCRIPTION OF CERTAIN INVENTIVE EMBODIMENTS

Figure 1:
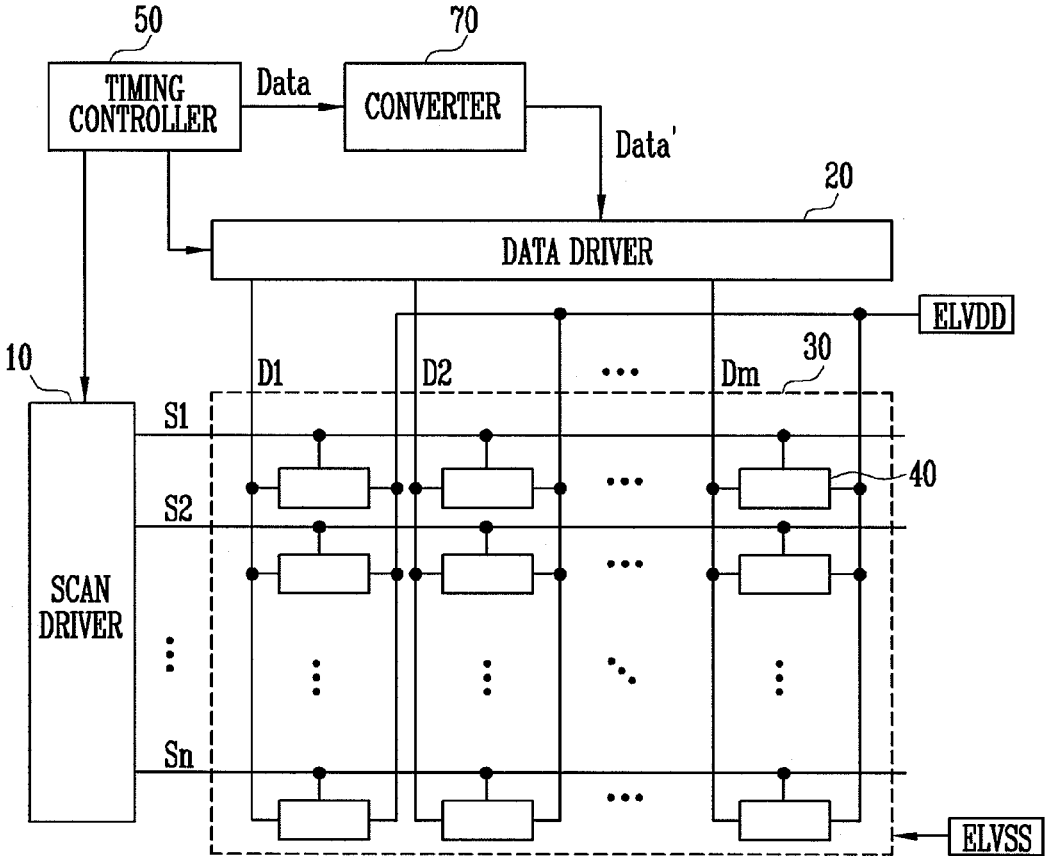
FIG. 1 is a block diagram of an organic light emitting display device according to an embodiment.

In the following detailed description, only certain exemplary embodiments have been shown and described, simply by way of illustration. As those skilled in the art would realize, the described embodiments may be modified in various ways, without departing from the spirit or scope of the present invention. Accordingly, the drawings and description are to be regarded as illustrative in nature and not restrictive. In addition, when an element is referred to as being "on" another element, it may be directly on the another element or it may be indirectly on the another element with one or more intervening elements interposed therebetween. Also, when an element is referred to as being "connected to" another element, it can be directly connected to the another element or be indirectly connected to the another element with one or more intervening elements interposed therebetween. Hereinafter, like reference numerals generally refer to like elements.

Hereinafter, embodiments will be described in more detail with reference to the accompanying drawings.

FIG. 1 is a block diagram of an organic light emitting display device according to an embodiment.

Referring to FIG. 1, an organic light emitting display device includes a display panel 30 including a plurality of pixels connected with scan lines S1 to Sn and data lines D1 to Dm, a scan driver 10 for driving the scan lines S1 to Sn, a data driver 20 for driving the data lines D1 to Dm, a timing controller 50 controlling the scan driver 10 and the data driver 20, and a converter 70 receiving first data Data from the timing controller 50, and converting the first data to second data Data' and transferring the second data Data' to the data driver 20.

The timing controller 50 generates a data driving control signal and a scan driving control signal corresponding to received synchronization signals. The data driving control signal generated in the timing controller 50 is supplied to the data driver 20 and the scan driving control signal is supplied to the scan drive 10. In addition, the timing controller 50 provides the first data Data to the converter 70 according to received data signals.

The scan driver 10 receives the scan driving control signal from the timing controller 50. The scan driver 10 receives the scan driving control signal, generates the scan signal and, sequentially supplies the generated scan signal to the scan lines S1 to Sn.

The data driver 20 receives the data driving control signal from the timing controller 50, receives the second data Data' from the converter 70, and supplies the second data Data' to the data lines D1 to Dm synchronized with the scan signal.

The display panel 30 receives first power ELVDD and second power ELVSS, and supplies the first power ELVDD and the second power ELVSS to each of the pixels 40. Each of the pixels 40 generate light corresponding to the data signal by controlling current according to the data signal. The current flows to the second power ELVSS from the first power ELVDD through a light emitting element. Each of the pixels 40 generate light having luminance corresponding to the data signal.

The converter 70, which uses automatic current limit (ACL) driving, calculates an average value of luminance components by extracting luminance components Y of the first data Data, acquires the peak brightness ratio (hereinafter, referred to as PBR) value with a look-up table LUT, and converts the first data Data to the second data Data' by multiplying the first data Data by the PBR value.

The automatic current limit driving represents a method in which the peak brightness of video is inversely related to an emission area of the display panel. That is, in the case in which the emission area of the display panel is small, the peak brightness has a high value and, in the case in which the emission area is large, the peak brightness has a lower value.

As such, the maximum power consumption of the organic light emitting display device has an upper limit and because the variation in the power consumption is reduced, the lifespan of the organic light emitting display device is extended.

In general, automatic current limit driving method includes controlling the peak brightness by controlling an emission time according to the emission area of the display panel, but when this is done, an emission control driver is additionally provided in addition to the scan driver 10 in order to control the emission time.

In some embodiments, the automatic current limit driving method includes converting the data provided to the data driver, and does not include controlling the emission time.

The automatic current limit driving method according to some embodiments is described below.

The luminance components Y of the first data Data are extracted by converting color coordinates of RGB data (first data) corresponding to one video frame from the timing controller 50 and an average value of the extracted luminance components is calculated. The average value of the luminance components is provided to the look-up table to acquire the peak brightness ratio (PBR) corresponding to the average value and the input RGB data is multiplied by the peak brightness ratio to generate the converted RGB data (second data). The converted RGB data (second data) are output to the data driver 20.

The look-up table may be represented as a graph in which the peak brightness ratio is inversely related to the emission area of the display panel where the horizontal axis is an emission area ratio of the display surface and the vertical axis is the peak brightness ratio. In some embodiments, both the horizontal axis and the vertical axis are normalized to have values from 0 to 1.

According to the look-up table, when the emission area is relatively low, the PBR value is relatively high. In addition, when the emission area is high, the PBR value is relatively low.

As a result, the ACL uses dynamic contrast by increasing the PBR value for a dark input video and reduces the power consumption by decreasing the PBR value for a bright input video.

An ACL curve, that is, a graph of the LUT may be generated through linear interpolation for a number of points.

The automatic current limit driving has significant benefits for the dynamic contrast and reduction of the power consumption. However, when the level of the ACL is high, the automatic current limit driving may have a problem in that flicker is generated.

Figure 2A:
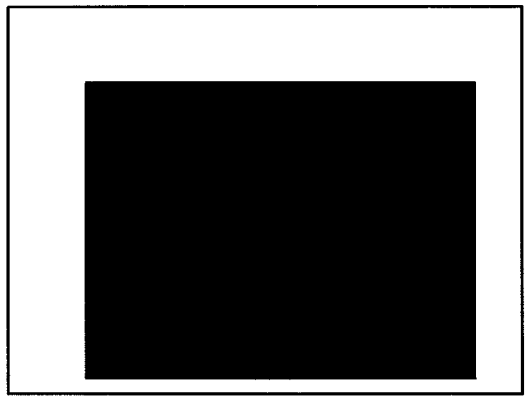
FIGS. 2A to 2C are video frame diagrams illustrating a video sequence is which flicker is generated when ACL is applied.
Figure 2B:
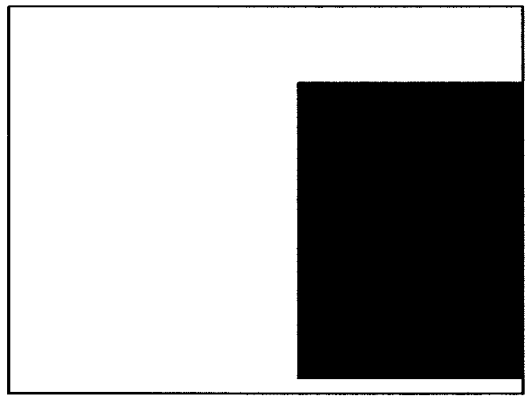
Figure 2C:
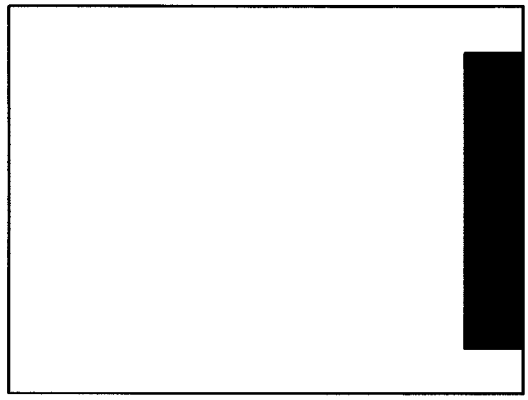

FIGS. 2A to 2C are sequential video frame diagrams illustrating a video sequence is which flicker is generated when ACL is applied.

Referring to FIGS. 2A to 2C, flicker is a result of a moving black box on a white background.

When the screen of the video frame of FIG. 2A is changed to the screen of the video frames of FIGS. 2B and 2C, the black box moves to the right. Because of the ACL, the white background becomes darker as the black box moves to the right. That is, the brightness of the white background depends on the emission area. Because the time of the video frame is short, the brightness change is recognized as flicker to human perception.

Because the black box moves and is only partly shown in FIGS. 2B and 2C, the average value of the luminance components for frames of FIGS. 2B and 2C is greater than the average value of the luminance components of the frame of FIG. 2A. In accordance with the ACL driving, the PBR value changes with the average value of the luminance components. Because the PBR value changes, the white background of FIGS. 2A-2C have differing brightness, and flicker is generated.

To improve the video quality by reducing flicker, embodiments of the driving method can include detecting a sequence of video frames where generation of the flicker is anticipated and applying the peak brightness ratio of the previous video frame to data signals of the current video frame.

When flicker is not anticipated, the PBR value of the current frame is used by the converter 70 to generate data for the current frame by multiplying the first data Data by the PBR value of the current frame to generate second data Data'. When flicker is anticipated, the PBR value of the previous frame is used by the converter 70 to generate data for the current frame by multiplying the first data Data by the PBR value of the previous frame to generate second data Data'. Therefore, in the case in which the generation of the flicker is anticipated, it is possible to remove the generated flicker by storing and applying the previous PBR value.

Figure 3:
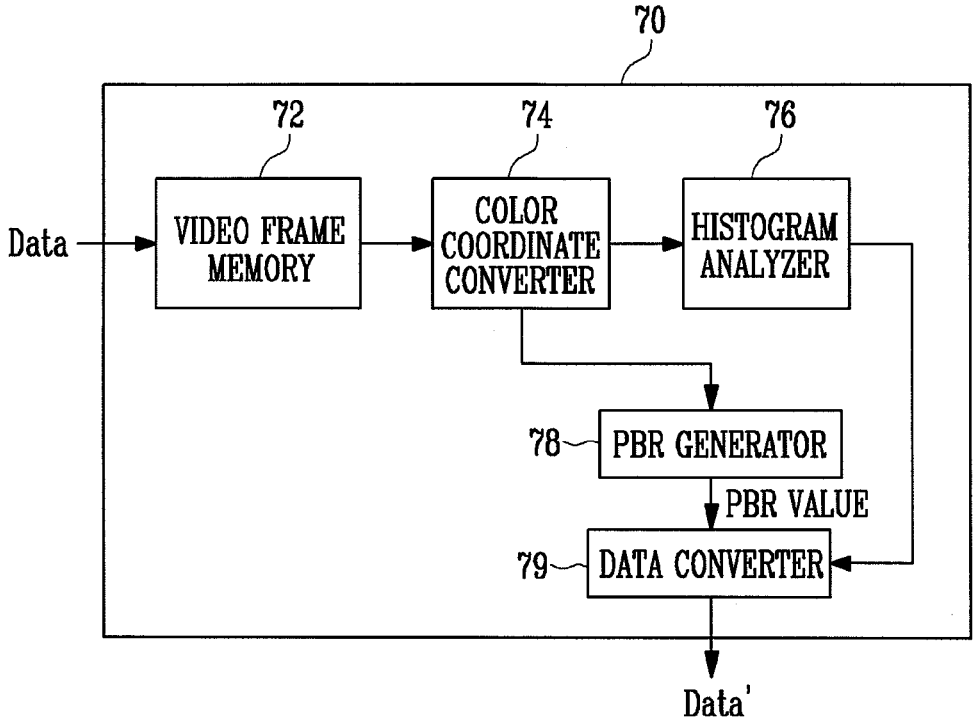
FIG. 3 is a block diagram of an embodiment of a converter shown in FIG. 1.
Figure 4:
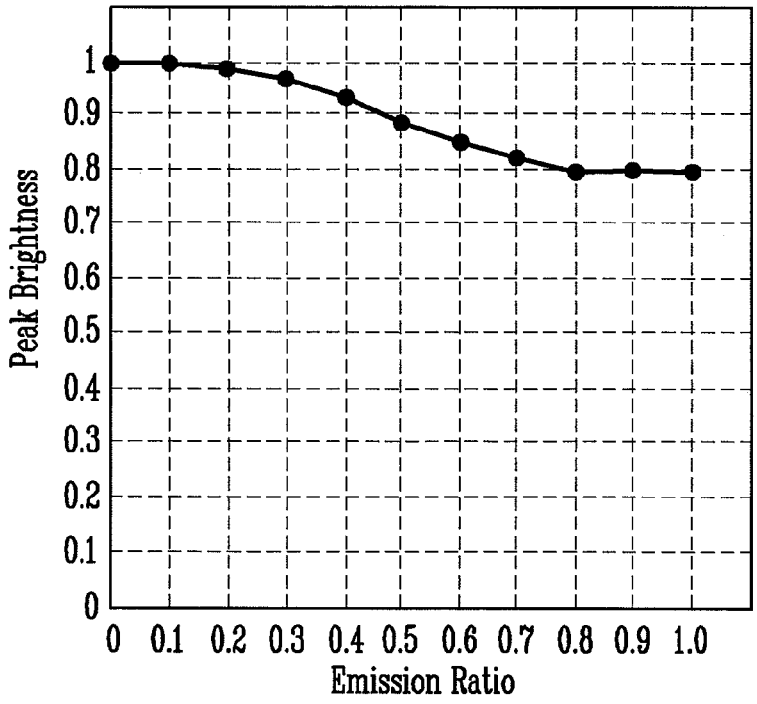
FIG. 4 is a graph showing one example of a look-up table of FIG. 3.

FIG. 3 is a block diagram of an embodiment of a converter shown in FIG. 1, and FIG. 4 is a graph showing one example of a look-up table of FIG. 3.

Referring to FIG. 3, the converter 70 includes a video frame memory 72 storing the first data Data received from the timing controller 50, a color coordinate converter 74 converting color coordinates of the first data Data stored for each video frame and extracting the luminance components of the first data Data, a histogram analyzer 76 analyzing histogram information on the extracted luminance components of the first data, PBR generator 78 calculating peak brightness ratios corresponding to the extracted luminance components of the first data, and a data converter 79 generating the second data Data' generated by converting the first data Data with the peak brightness ratio value calculated in the look-up table to the second data Data'. In some embodiments, the first data Data and the second data Data' are RGB data.

The video frame memory 72 stores first data Data corresponding to at least two successive video frames.

The video frame memory 72 stores first data Data of an n-th video frame and first data Data of an n+1-th video frame. Therefore, the data corresponding to two successive video frames may be stored at the same time.

The color coordinate converter 74 converts the color coordinates of the first data Data (RGB data). As one example, the color coordinate converter 74 may convert the RGB data to YCbCr data or HSV data. When the RGB data are converted to YCbCr data, the conversion may be performed according to the following equations.

$$Y=0.29900R+0.58700G+0.11400B$$

$$Cb=-0.16874R\ 0.33126G+0.50000B$$

$$Cr=0.50000R\ 0.41869G-0.08131B$$

That is, when the RGB data are converted to the YCbCr, the luminance information Y of the first data may thus be extracted.

Accordingly, the color coordinate converter 74 serves to extract the luminance components by converting the color coordinates of the inputted first data (RGB data) and calculate the extracted average value of the luminance components.

Further, the average value of the luminance components is provided to the PBR generator 78 and the peak brightness ratio (PBR) value corresponding to the average value is output by the PBR generator 78 to data converter 79. In some embodiments, the PBR generator 78 comprises a look-up table.

As shown in FIG. 4, the data of an embodiment of the PBR generator 78 is shown as a graph in which the peak brightness is inversely related to the emission area of the display panel. In the graph, the horizontal axis is an emission area ratio for the display surface and the vertical axis is the peak brightness ratio. Both the horizontal axis and the longitudinal axis are normalized to have values from 0 to 1.

In order to detect anticipated flicker, the YCbCr data is provided to the histogram analyzer 76. In some embodiments, the histogram analysis is performed by the histogram analyzer 76 through comparison of the luminance components of the first data Data for successive video frames.

An example in which flicker is anticipated through the histogram analysis is described below.

Figure 5A:
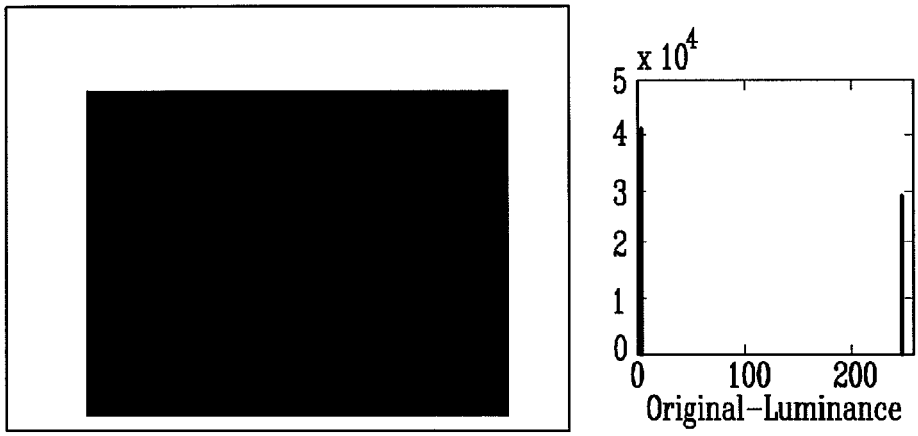
FIGS. 5A to 5C are video frame and luminance diagrams illustrating an example of histogram analysis according to an embodiment.
Figure 5B:
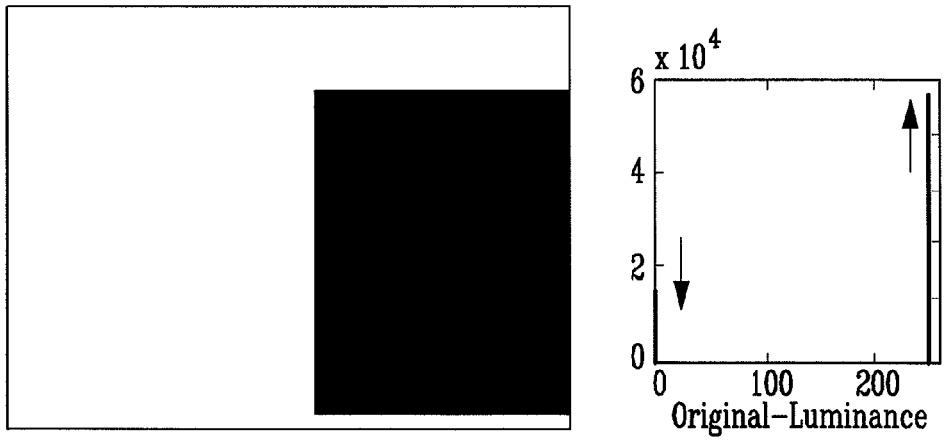
Figure 5C:
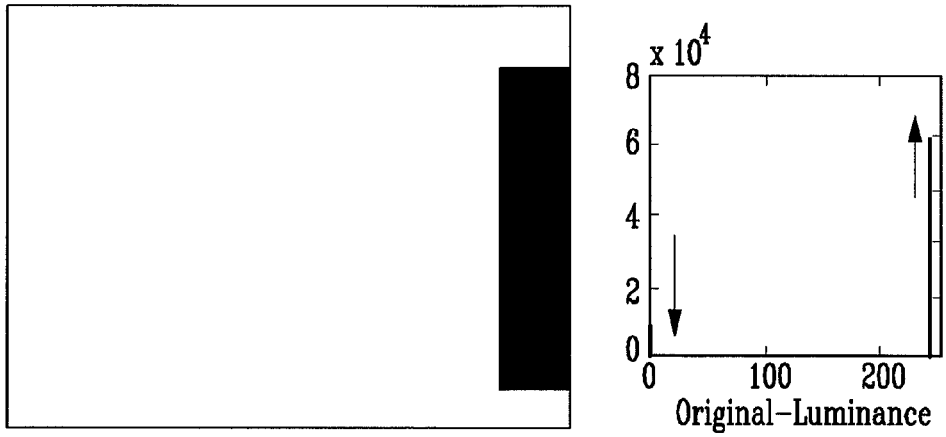

FIGS. 5A to 5C are video frame and luminance diagrams illustrating an example of histogram analysis according to an embodiment.

First, FIG. 5A is a video frame diagram and a histogram of the luminance components of the first data for the video frame of FIG. 5A.

Referring to the histogram of FIG. 5A, two vertical lines having different heights are shown. The horizontal axis of the histogram is a gray-scale value (gray-scale 0 to gray-scale 255 as one example) and the vertical axis is a frequency number of occurrences of each gray-scale value.

The video frame of FIG. 5A includes a black box and a white background and the area of the black box is larger than the area of the background.

Accordingly, referring to the histogram, the number of occurrences of the minimum gray-scale is larger than the frequency number of the maximum gray-scale.

Next, FIG. 5B is a video frame diagram and a histogram of the luminance components of the first data for the video frame of FIG. 5B. In FIG. 5B, the area of the black box is less than the area of the black box of FIG. 5A, and the area of the white background is greater than the area of the background in FIG. 5A. Accordingly, the number of occurrences of the minimum gray-scale in FIG. 5B is less than the number of occurrences of the minimum gray-scale in FIG. 5A, and the number of occurrences of the maximum gray-scale in FIG. 5B is greater than the number of occurrences of the maximum gray-scale in FIG. 5A.

Next, FIG. 5C is a video frame diagram and a histogram of the luminance components of the first data for the video frame of FIG. 5C. In FIG. 5C, the area of the black box is less than the area of the black box of FIG. 5B, and the area of the white background is greater than the area of the background in FIG. 5B. Accordingly, the number of occurrences of the minimum gray-scale in FIG. 5C is less than the number of occurrences of the minimum gray-scale in FIG. 5B, and the number of occurrences of the maximum gray-scale in FIG. 5C is greater than the number of occurrences of the maximum gray-scale in FIG. 5B.

As shown in FIGS. 5A-5C, the histogram data of the luminance components significantly changes from frame to frame. Where the change is greater than a threshold, flicker is anticipated.

As described above, flicker is generated in ACL driving because of the change of the PBR value between consecutive frames. This condition can be anticipated because the video frame where the flicker is generated has a different number of maximum and minimum gray-scales when compared with the previous video frame.

The histogram analyzer 76 generates a select signal which indicates whether the PBR of the data of the current frame or the PBR of the data of the previous frame should be used. The histogram analyzer 76 provides the select signal to the data converter 79.

The data converter 79 receives the first data from, for example, the video frame memory. The data converter 79 also receives the PBR of the current frame from the PBR generator 78 and the select signal from the histogram analyzer 76. Based on the select signal, the data converter 79 generates second data by multiplying the first data by either the PBR of the current frame or the stored PBR of the previous frame.

Consequently, the converter 70 removes flicker by detecting video frames where flicker is anticipated through the histogram analysis and by applying the PBR value of the previous video frame to the first data corresponding to the detected video frame.

That is, by considering whether the number of occurrences of the maximum and minimum gray-scales of a histogram for a video frame is different in comparison with the previous video frame, flicker is anticipated and not the current PBR value but the previous PBR value is applied to generate the second data.

Figure 6:
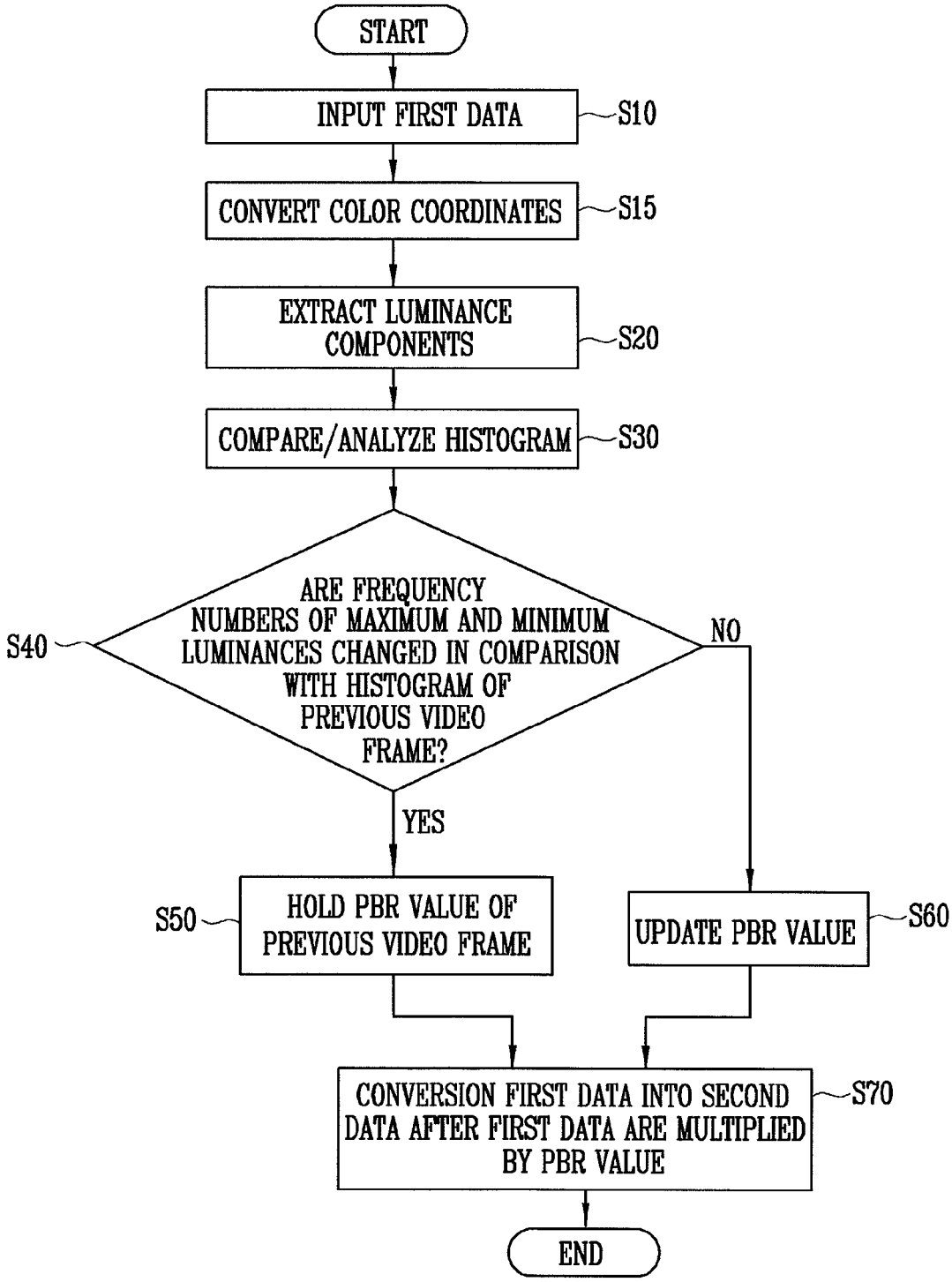
FIG. 6 is a flowchart illustrating an ACL driving method according to an embodiment.

FIG. 6 is a flowchart describing an ACL driving method according to an embodiment.

Referring to FIG. 6, color coordinates of first data (RGB data) corresponding to successive video frames (n−1-th and n-th video frames) are converted. As one example, the RGB data may be converted to YCbCr data or HSV data and thus, luminance information Y of the first data may be extracted (S10, S15 and S20).

Thereafter, histogram data of the luminance information of the first data corresponding to the consecutive video frames are compared and analyzed (S30).

In some embodiments, a horizontal axis of the histogram is a gray-scale value (gray-scale 0 to gray-scale 255 as one example) and a vertical axis is a number of occurrences of each gray-scale value.

Through the comparison and analysis of the histograms, it is detected whether the number of the maximum and minimum gray-scales in a histogram of a current video frame (n-th video frame) is different from the number of the maximum and minimum gray-scales in a histogram of the previous video frame (n−1-th video frame) by more than a threshold. When the difference is greater than the threshold, the current video frame (n-th video frame) is determined as a video frame where flicker is anticipated (S40).

If the current video frame (n-th video frame) is determined as a video frame where flicker is anticipated, the PBR value applied to the previous video frame (n−1-th video frame) is stored (S50).

The first data Data for the current video frame (n-th video frame) are multiplied by the stored PBR value and converted to second data Data' and the converted second data Data' are provided to a data driver 20 (S70).

If the current video frame (n-th video frame) is determined as a video frame where flicker is not anticipated, the PBR value applied to the current video frame (n−1-th video frame) is stored (S60).

While the present invention has been described in connection with certain exemplary embodiments, it is to be understood that the invention is not limited to the disclosed embodiments, but, on the contrary, is intended to cover various modifications and equivalent arrangements.

What is claimed is:

1. An organic light emitting display device, comprising:

a pixel unit including a plurality of pixels connected with scan lines and data lines;

a timing controller configured to supply frames of first data;

a converter configured to receive the frames of first data, the converter comprising:

a color coordinate converter configured to determine luminance components of the first data of each frame, a peak brightness ratio (PBR) generator, configured to determine a PBR for the first data of each frame, wherein the PBR is determined based on the determined luminance components, and a data converter configured to generate second data for each frame based on the first data for each frame and on the PBR; and a data driver configured to receive the second data from the converter and to provide the second data to the data lines.

2. The organic light emitting display device of claim 1, wherein the converter further comprises:

a video frame memory configured to store first data for each frame; and a histogram analyzer configured to analyze histogram information of the luminance components of the first data of each frame, wherein the luminance component extractor comprises a color coordinate converter configured to convert color coordinates of the first data for each frame and to determine the luminance components of the first data for each frame, wherein the PBR generator comprises a look-up table configured to generate a peak brightness ratio value corresponding to the extracted luminance components of the first data.

3. The organic light emitting display device of claim 2, wherein the video frame memory is configured to store first data of at least two successive frames.

4. The organic light emitting display device of claim 2, wherein the first data are RGB data and the RGB data are converted to YCbCr data or HSV data by the color coordinate converter.

5. The organic light emitting display device of claim 2, wherein the look-up table has peak brightness ratio data which is inversely related to the emission area of the display device.

6. The organic light emitting display device of claim 2, wherein the histogram analyzer compares and analyzes histograms for luminance components of first data corresponding to a current frame and a previous frame.

7. The organic light emitting display device of claim 6, wherein the histogram analyzer determines whether the number of maximum and minimum gray-scales of the current frame is different from the number of maximum and minimum gray-scales of the previous frame.

8. The organic light emitting display device of claim 7, wherein if the number of maximum and minimum gray-scales of the current and previous frames is different by more than a threshold, the data converter generates the second data by applying the PBR value of the previous frame to the first data of the current frame.

9. The organic light emitting display of claim 8, wherein if the number of maximum and minimum gray-scales of the current and previous frames is different by more than the threshold, the data converter generates the second data by multiplying the first data of the current frame by the PBR value of the previous frame.

10. The organic light emitting display device of claim 7, wherein if the number of maximum and minimum gray-scales of the current and previous frames is not different by more than a threshold, the data converter generates the second data by applying the PBR value of the current frame to the first data of the current frame.

11. The organic light emitting display of claim 10, wherein if the number of maximum and minimum gray-scales of the current and previous frames is not different by more than the threshold, the data converter generates the second data by multiplying the first data of the current frame by the PBR value of the current frame.

12. A driving method of driving an organic light emitting display device, the method comprising:

converting color coordinates of first data of a plurality of frames;

extracting luminance information of the converted first data of successive frames;

comparing and analyzing histogram data of the luminance information of the first data of the successive frames;

detecting whether the number of maximum and minimum gray-scales in the luminance information for a current frame is different from the number of maximum and minimum gray-scales in the luminance information of a previous frame;

based on a difference in the number of maximum and minimum gray-scales in the current and previous frames, determining whether flicker in the current frame is anticipated; and converting the first data of each frame to second data for each frame by applying a peak brightness ratio (PBR) value to the first data of each frame, wherein if flicker is anticipated the peak brightness ratio value is equal to a peak brightness ratio value applied to the previous video frame.

13. The driving method of an organic light emitting display device of claim 12, wherein the first data are RGB data and the RGB data are converted to YCbCr data or HSV data by a color coordinate converter.

14. The driving method of an organic light emitting display device of claim 12, further comprising converting the first data of each frame to the second data for each frame by applying a PBR value calculated for the first data of the current frame to the first data of the current frame if flicker is not anticipated.

15. The driving method of an organic light emitting display device of claim 14, wherein applying the PBR to the first data comprises multiplying the first data by the PBR.

16. The driving method of an organic light emitting display device of claim 14, further comprising:

determining an average value of luminance components of the first data; and determining a PBR based on the average value.

17. The driving method of an organic light emitting display device of claim 16, wherein determining the PBR comprises selecting the PBR from data in which PBR values are inversely related to emission area.

18. The driving method of an organic light emitting display device of claim 12, wherein applying the PBR to the first data comprises multiplying the first data by the PBR.

19. An organic light emitting display device, comprising:

a pixel unit including a plurality of pixels;

a converter configured to receive frames of first data, the converter comprising:

a peak brightness ratio (PBR) generator configured to determine a PBR for the first data of each frame, wherein the PBR is determined based on a luminance of the first data, and a data converter configured to generate second data for each frame based on the first data for each frame and on a selected one of the generated PBRs; and a data driver configured to provide the second data to the pixels.

20. The organic light emitting display device of claim 19, wherein the selected PBR is selected according to a difference between first data of a current frame and first data of a previous frame.

* * * * *